US012114755B2

(12) United States Patent
Leroux

(10) Patent No.: US 12,114,755 B2
(45) Date of Patent: Oct. 15, 2024

(54) WIPER INTENDED TO BE FITTED ON A COSMETIC PRODUCT CONTAINER

(71) Applicant: L'OREAL, Paris (FR)

(72) Inventor: Stéphane Leroux, Clichy (FR)

(73) Assignee: L'Oreal, Paris (FR)

( * ) Notice: Subject to any disclaimer, the term of this patent is extended or adjusted under 35 U.S.C. 154(b) by 634 days.

(21) Appl. No.: 17/293,147

(22) PCT Filed: Dec. 12, 2019

(86) PCT No.: PCT/EP2019/084973
§ 371 (c)(1),
(2) Date: May 12, 2021

(87) PCT Pub. No.: WO2020/126856
PCT Pub. Date: Jun. 25, 2020

(65) Prior Publication Data

US 2022/0007814 A1 Jan. 13, 2022

(30) Foreign Application Priority Data

Dec. 19, 2018 (FR) ..... 18 73284

(51) Int. Cl.
*A46B 17/08* (2006.01)
*A45D 34/04* (2006.01)
*A45D 40/26* (2006.01)

(52) U.S. Cl.
CPC ..... *A45D 34/046* (2013.01); *A45D 40/267* (2013.01); *A45D 2200/1072* (2013.01)

(58) Field of Classification Search
CPC ..... A45D 34/046; A45D 40/267
USPC ..... 401/121
See application file for complete search history.

(56) References Cited

U.S. PATENT DOCUMENTS 7,186,044 B2 3/2007 Bailly
7,914,220 B2 * 3/2011 Neuner ..... A45D 40/267 401/122
8,783,987 B2 * 7/2014 Kulik ..... A45D 34/046 401/122

(Continued)

FOREIGN PATENT DOCUMENTS

CN 105828660 A 8/2016
EP 1 726 232 A1 11/2006

(Continued)

OTHER PUBLICATIONS

Japanese Office Action issued Aug. 1, 2022 in Japanese Patent Application No. 2021-532943, 5 pages.

(Continued)

*Primary Examiner* — Jennifer C Chiang

(57) ABSTRACT

A wiper configured to be fitted on a container containing a product, to be applied by an applicator, the wiper including a cylindrical body extending along a longitudinal axis, a part of which forms the actual wiping member, the body having, along the longitudinal axis, a rim configured to rest on an edge of the container delimiting an opening therein, a coupler configured to couple the wiper to the container, and a portion that is elastically deformable along the longitudinal axis and is provided between the rim and the coupler, the elastically deformable portion is in the form of an openwork portion of the body.

14 Claims, 4 Drawing Sheets

(56) References Cited

U.S. PATENT DOCUMENTS

| | | | | |
|---|---|---|---|---|
| 8,801,310 | B2 * | 8/2014 | Kulik | A45D 40/267 401/122 |
| 10,080,416 | B2 * | 9/2018 | Caulier | A45D 40/267 |
| 2002/0195117 | A1 | 12/2002 | Bailly | |
| 2006/0198689 | A1 | 9/2006 | Neuner et al. | |
| 2007/0177927 | A1 | 8/2007 | Kurihara | |
| 2014/0290681 | A1 * | 10/2014 | Pires | A45D 34/046 401/121 |
| 2019/0133295 | A1 | 5/2019 | Moretti | |

FOREIGN PATENT DOCUMENTS

| | | | |
|---|---|---|---|
| EP | 3 159 988 | A1 | 4/2017 |
| EP | 3 479 727 | A1 | 5/2019 |
| FR | 2 826 246 | A1 | 12/2002 |
| FR | 2 897 761 | A1 | 8/2007 |
| FR | 3 005 835 | A1 | 11/2014 |
| GB | 635771 | | 4/1950 |
| GB | 957761 | | 5/1964 |
| JP | 2003-47524 | A | 2/2003 |
| JP | 2012-30822 | A | 2/2012 |
| JP | 2018-191887 | A | 12/2018 |
| WO | WO 2006/093688 | A2 | 9/2006 |

OTHER PUBLICATIONS

International Search Report issued Feb. 12, 2020 in PCT/EP2019/084973 filed Dec. 12, 2019, 4 pages.

Combined Chinese Office Action and Search Report issued on Sep. 29, 2023 in Chinese Patent Application No. 201980083296.9 (with English translation of category of cited documents), 8 pages.

* cited by examiner

WIPER INTENDED TO BE FITTED ON A COSMETIC PRODUCT CONTAINER

The present invention relates to a wiper intended to be fitted on a packaging and application assembly, as is used in particular in the field of cosmetics.

Typically, such a packaging and application assembly comprises a container constituted of a body, which is in particular cylindrical and an end of which, opposite the bottom, forms a neck of which a free edge delimits an opening.

Such an assembly also comprises an applicator member, in particular a mascara brush or an eyeliner, one end of which is secured to a stem, which is secured to a cap intended to removably close said opening. The cap forms a gripping member for the applicator member. In the screwed-on position of the cap on the container, the applicator member is dipped in the product contained in the container.

Disposed in the neck of the container is a wiper, in particular in the form of an annular member, which is passed through by the applicator member, both during the introduction of the latter into the container through said opening and during the withdrawal thereof.

The wiper comprises an actual wiping part, which is realized in particular in the form of an annular lip, the applicator member, and optionally the stem connecting the applicator member to the cap, engaging with an edge of said wiping part. Thus, the quantity of product remaining on the applicator member can be metered relatively precisely, such that there is essentially no excess of product on the applicator member. Moreover, the stem can be literally wiped clean during this movement of withdrawing the applicator from the container such that the user does not soil her fingers during the application of the product.

For some applications, in particular for applicators of which the cross section varies significantly along their length, or for applicators which are intended to pick up a small quantity of product, or for applicators with a small section relative to the stem, it may be necessary to use a wiper of which the actual wiping part is made of elastically deformable material, in particular natural or synthetic rubber.

The use of a wiper made of such an elastically deformable material is described in the U.S. Pat. No. 4,617,948. According to that patent, the wiper is placed on an internal edge of the container and held in place by means of an additional part forming a threaded neck. By causing the container to be produced in two parts, such a disposition multiplies the mounting operations and further increases the manufacturing cost of the assembly.

In order to remedy the drawbacks of a wiper according to the document U.S. Pat. No. 4,617,948, the document FR2826246, in the name of the Applicant, proposes a wiper which is easier to mount within a container. To this end, the wiper according to that document FR2826246 is made at least partly of an elastically deformable material and comprises a tubular body extending along a longitudinal axis, a part of which forms the actual wiping member and has, along this axis, a rim for resting on the neck of the container and coupling means designed to come into abutment against a shoulder of the container in the mounted position of the wiper.

According to that document FR2826246, the coupling means of the wiper are in the form of one or more flexible lips that extend over the outer surface of the body and, when not under load, form an acute angle with the body so as to offer a resistance to the introduction of the wiper into the container that is substantially less than the resistance that said lip offers during the withdrawal of the wiper from the container, thereby simplifying the mounting of the wiper inside the container.

In order to mount the wiper according to that document FR2826246 within a container, the body of the wiper is partially inserted into the opening defined by the neck of the container, with the flexible lip(s) resting on the upper edge of the neck. A tool of elongate shape is then introduced into the wiper until it comes to bear against a transverse flange of the latter. The movement of the tool in the direction of the bottom of the container is then continued such that the wiper engages further in the neck of the container, in the direction of the bottom thereof. In doing so, the flexible lip(s) fold up in the direction of the body of the wiper. The downward movement of the wiper in the neck of the container continues until a free end of the lip is no longer next to the neck. In this position, the wiper is slightly loaded in elongation, and the lip(s) open out radially in order to return to their initial form, forming an acute angle of around 45° with the body of the wiper. In this position, the rim of the wiper rests on the upper edge of the neck of the container. The tool then begins a withdrawing movement in the opposite direction from the bottom of the container. By elastic return, the lip(s) are forced into engagement against the shoulder of the container, and therefore strongly prevent any movement that tends to cause the wiper to come out, the latter then being coupled solidly in the neck of the container.

However, the wiper according to that document FR2826246, although providing solutions to the problems set by prior wipers, has a number of drawbacks and requires improvement.

Specifically, the mounting of the wiper according to that document FR2826246 requires elongation, elastic axial stretching along the longitudinal axis of the body of the wiper within the neck of the container in order for the flexible lip(s) to be able to open out freely behind the shoulder and to keep the wiper within the neck of the container. The portion of the body of the wiper that is elongated, stretched along the longitudinal axis during the mounting of the wiper in the neck of the container is in the form of a tubular portion. Thus, in that document, the path of axial elongation of the wiper during the mounting thereof within the neck of the container and the elastic return of the wiper allowing the flexible lip(s) to bear behind the shoulder of the neck of the container are directly dependent on the dimensions and the constituent material of the stretchable tubular portion of the body of the wiper.

The wiper design according to that document FR2826246 therefore requires particularly precise dimensions of the stretchable tubular portion of the body of the wiper in order to ensure that the flexible lip(s) can open out freely behind the shoulder of the container when the stretchable tubular portion is stretched, and that the flexible lip(s) come to bear against the shoulder of the container when the load on the stretchable tubular portion is released. This is because excessively small dimensions of the stretchable tubular portion of the body of the wiper would entail a risk of the flexible lip(s) not opening out behind the shoulder of the container when the stretchable tubular portion is stretched and remaining next to the inner wall of the neck of the container, thereby impairing the hold of the wiper, the latter then only being held in the container by friction of the flexible lip(s) against the inner wall of the neck of the container. On the other hand, excessively large dimensions of the stretchable tubular portion of the body of the wiper would entail a risk of the flexible lip(s) not coming to bear against the shoulder of the container when the load on the stretchable tubular portion is released, resulting in the wiper being able to move to a certain extent inside the neck of the container, this being liable to impair the leaktightness of the container when it is closed by a closing element and to impair the quality perceived by the user.

Moreover, with such a design, the path of axial stretching of the stretchable tubular portion of the wiper is relatively restricted, since it is limited by the intrinsic deformation capability of the stretchable tubular portion of the body of the wiper, and a wiper according to that document FR2826246 having given dimensions will be suitable only for a restricted range of container neck heights.

The present application aims to remedy all or some of these drawbacks and, to this end, proposes a wiper intended to be fitted on a container containing a product, in particular a cosmetic product, to be applied by means of an applicator, said wiper comprising a cylindrical body extending along a longitudinal axis, a part of which forms the actual wiping member, said body having, along the longitudinal axis, a rim that is able to rest on an edge of the container delimiting an opening therein, coupling means intended to couple the wiper to the container, and a portion that is elastically deformable along the longitudinal axis and is provided between said rim and said coupling means, wherein the elastically deformable portion is in the form of an openwork portion of the body.

The employment of an openwork portion of the body to form the portion that is elastically deformable along the longitudinal axis of the wiper makes it possible to have a path of elastic axial stretching for the deformable portion that is greater than with a wiper according to the document FR2826246, thereby allowing the wiper according to the invention to adapt to a greater range of container neck heights and to easily make up for any dimensional variations thereof along the longitudinal axis that are due to manufacturing tolerances of the container. Thus, the dimensioning of the openwork portion of the wiper according to the invention requires less precision than that of the stretchable tubular portion of the wiper according to the document FR2826246 in order to ensure that the coupling means of the wiper can freely open out behind the shoulder of the container when the elastically deformable portion is stretched, and that the coupling means of the wiper come to bear against the shoulder of the container when the load on the elastically deformable portion is released. The reliability of the mounting of the wiper within the neck of the container is thus also improved.

Furthermore, and in the manner of the wiper according to the document FR2826246, with the wiper according to the invention, an axial load exerted on the coupling means in a first direction causes an elastic bending movement of the latter with respect to the body, different from the elastic bending movement that results from the same axial load exerted in an opposite direction to the first direction.

Thus, and according to an advantageous configuration of the invention, an axial load exerted on the coupling means in a first direction causes the latter to bend elastically, tending to move a free part toward said body. By contrast, the same axial load, exerted in the opposite direction to the first direction, causes the coupling means to bend elastically, tending, at least firstly, to move a free part away from said body.

Preferably, the bending movement means a pivoting or tilting movement substantially about the joining zone connecting the coupling means to the body of the wiper.

The difference in resistance, during introduction and during withdrawal, may be obtained by configuring the coupling means such that they move aside, at least partially, during the introduction of the wiper into the neck of the container, in response to an axial pushing force exerted on the wiper. It is therefore easy to introduce the wiper. By contrast, once they have passed the neck of the container, the coupling means open out radially so as to oppose the removal of the wiper when an axial pulling force is exerted from above. Thus, the functions of "ease of mounting" and "solid coupling" are fulfilled in a very satisfactory manner, without one having to be penalized at the expense of the other.

According to one advantageous disposition of the wiper according to the invention, the openwork portion of the body comprises at least one rib that extends helically along the longitudinal axis and is bordered by two apertures in the circumferential direction, said apertures extending preferably helically along the longitudinal axis.

Preferably, the openwork portion comprises four ribs that extend helically along the longitudinal axis, said ribs being distributed preferably regularly about the longitudinal axis, each of the ribs extending in particular through an angular range of around 90°, said ribs being separated from one another in the circumferential direction by apertures.

According to a first embodiment variant, the openwork portion comprises two ribs that extend helically along the longitudinal axis, said ribs being preferably diametrically opposite one another about the longitudinal axis, each of the ribs extending in particular through an angular range of less than 90°, for example around 45°, said ribs being separated from one another in the circumferential direction by apertures. Advantageously, the openwork portion comprises two groups of at least two and in particular three ribs, each of the ribs of each group extending helically along the longitudinal axis, said groups of ribs being preferably diametrically opposite one another about the longitudinal axis, each of the ribs extending in particular through an angular range of less than 90°, in particular around 45°, said ribs of each group being separated from one another in the circumferential direction by apertures, and the groups of ribs being separated from one another in the circumferential direction by apertures.

According to a second embodiment variant, the openwork portion comprises at least one rib extending in a zigzag along the longitudinal axis, said rib comprising portions extending in the circumferential direction that are separated from one another along the longitudinal axis by slots and are connected together and to the body of the wiper by portions extending parallel to the longitudinal axis, and said rib being bordered by two apertures in the circumferential direction.

Advantageously, the body has a shoulder situated along the longitudinal axis between the elastically deformable portion and the coupling means. This shoulder is advantageously intended to cooperate with a tool for mounting the wiper in the neck of a container, in particular in order to bring about the elastic axial deformation of the openwork portion forming the elastically deformable portion.

According to one advantageous disposition, the body of the wiper has, along the longitudinal axis, a first end that is intended, in the mounted position of the wiper on the container, to face a bottom of the container, and a second end at the opposite end from the first, and the coupling means comprise at least one flexible lip extending over the outer surface of the body, a first end of which is attached to the body in a joining zone, a second end of the lip being free, and wherein said lip, when not under load, forms an acute angle with the longitudinal axis of the body so as to offer resistance to the introduction of the wiper into the container that is substantially less than the resistance that said lip offers when the wiper is withdrawn from the container.

Preferably, said angle is between 30° and 60°, preferably between 35° and 55°, and in particular around 45°. Such an angle is chosen in particular depending on the material forming the coupling means, and depending on the desired solidity of the coupling.

According to a preferred embodiment of the wiper according to the invention, the flexible lip extends discontinuously in the circumferential direction about the longitudinal axis over the outer surface of the body.

In a variant, the flexible lip extends continuously in the circumferential direction about the longitudinal axis over the outer surface of the body.

In one embodiment, the joining zone between the flexible lip and the cylindrical body of the wiper is disposed in the vicinity of the first end of the body. This results in a wiper having a reduced size along the longitudinal axis.

In a variant, the joining zone between the flexible lip and the cylindrical body of the wiper is disposed at a non-zero distance from said first end of the body. Thus, the body of the wiper defines, under the joining zone, a skirt portion that makes it possible to position the wiper in the opening delimited by the neck of the container before the axial pushing force aimed at inserting it completely into the neck of the container is exerted.

In its part intended to be in the neck, that is to say between the upper rim and the coupling means, the body of the wiper may have an outside diameter such that it is lightly gripped inside the neck. This is not a necessity, however.

The actual wiping member may be formed by an inner edge of reduced section of the cylindrical body, said inner edge being situated in the vicinity of the first end of the body of the wiper or at a non-zero distance from the first end of the body of the wiper. The diameter of the edge of reduced section is chosen in particular depending on the desired wiping of the applicator member, and on the diameter of the stem connecting the applicator member to the gripping member, assuming that said stem needs to be wiped as it passes through the wiper.

If the inner edge of reduced section of the cylindrical body is situated at a non-zero distance from the first end of the body of the wiper, the edge of said first end can itself form an element with which all or part of the applicator member can engage as it is withdrawn, producing as it were, with the edge of reduced section, two levels of wiping of the applicator member.

The inner edge of reduced cross section may be situated axially between the first end of the body and said joining zone, at a non-zero distance from the latter. This avoids the creation of excessive rigidity of the wiper in the vicinity of the joining zone, such excessive rigidity making it harder to introduce the wiper into the container.

The inner edge of reduced cross section may be connected to the cylindrical body by a wall inclined in the direction of the first end of the body of the wiper. The angle of inclination of the inclined wall with respect to the longitudinal axis may be around 45°.

In a variant, the edge of reduced section is constituted of the free edge of an annular lip inclined in the direction of the first end. The angle of inclination of the lip may be around 45°.

Advantageously, the outer surface of the body has, next to the coupling means, a recess. By virtue of these dispositions, the resistance offered to the introduction of the wiper into the container by the coupling means is further reduced. Specifically, the presence of the recess at the coupling means allows the latter to fit inside the recess when they bend in the direction of the body of the wiper during the introduction of the latter into the neck of the container.

Advantageously, the wiper is at least partially made of elastically deformable material. Preferably, at least the wiping member, the coupling means and the elastically deformable portion are made of an elastically deformable material. Preferably, however, the wiper is made entirely of elastically deformable material. The expression "elastically deformable" means that the material is flexible and/or stretchable in a reversible manner, preferably both flexible and stretchable.

The elastically deformable material may be chosen from thermoplastic or crosslinked elastomers, in particular EPDMs, natural rubbers, nitrile, butyl or silicone elastomers. In the case of a crosslinked elastomer, the wiper is manufactured in a compression mold, heated to the appropriate temperature. In a variant, the elastically deformable material is chosen from polymers, for example polyolefins, such as polyethylene (PE), or thermoplastic polymers, such as polypropylene (PP), polybutylene terephthalate (PBT), or acrylonitrile butadiene styrene (ABS).

The employment of an elastically deformable portion in the form of an openwork portion according to the invention is particularly advantageous when the wiper is made entirely or partially of a relatively rigid material, for example a material having a Young's modulus greater than or equal to 200 MPa. Specifically, in this case, the constituent material of the wiper has a limited intrinsic deformation capability, and in particular a limited axial extension capability along the longitudinal axis, and the employment of an elastically deformable portion in the form of an openwork portion makes it possible to have, within the wiper, a portion with an increased deformation capability, and in particular an increased axial extension capability. In this way, it is possible to produce wipers made of relatively rigid materials that are capable of adapting to different container neck heights and of ensuring reliable and robust fixing within the container neck.

According to another embodiment, a first portion of the wiper may be made with a first, elastically deformable, material, the actual wiping member, the coupling means, and the elastically deformable portion being disposed on this first portion, a second portion being made from a second material, different than the first, said wiper being made in particular by co-injection-molding or overmolding of these two materials and/or by mechanically assembling the first and second wiper portions. To this end, in particular in the case of co-injection-molding, use will preferably be made of two physico-chemically compatible materials.

The second material preferably comprises a polyolefin, in particular a polypropylene or a polyethylene.

The present invention also relates to an assembly for packaging and applying a product, in particular a cosmetic product, said assembly comprising a container designed to contain the product, and an applicator member for applying said product, wherein said assembly also comprises a wiper as defined above, said wiper being able to be passed through by said applicator member when the latter is withdrawn from the container, so as to allow the quantity of product remaining on the applicator member to be metered.

Preferably, the container is formed by a body that is separated from a neck by a shoulder, a free edge of the neck delimiting an opening in the vicinity of which said wiper is mounted.

Such a container may be obtained by molding a material such as a polypropylene.

In a variant, the container may be made of glass. In such a case, the employment of a wiper according to the invention is particularly advantageous, inasmuch as, in such glass containers, it is particularly difficult, if not impossible, to provide in the neck of the container a groove designed to cooperate with a protrusion that is provided on the outer surface of the body of the wiper and makes it possible to enhance the hold of the wiper inside the neck of the container. Specifically, in such a case, the wiper is held in position inside the neck of the container only by the rim in the direction of introduction of the wiper into the container and by the coupling means in the direction of withdrawal of the wiper from the container. The employment of the elastically deformable portion in the form of an openwork portion of the wiper according to the invention making it possible to ensure optimal cooperation of the coupling means of the wiper with the shoulder of the container thereby improves the reliability of the hold of the wiper in the neck of the container.

Advantageously, in the mounted position of the wiper on the container, the coupling means are substantially in abutment against the shoulder. In this position, the coupling means are disposed under the shoulder and are or are able to be in abutment against the latter.

Preferably, in the mounted position of the wiper on the container, the coupling means and/or the elastically deformable portion are elastically loaded. This overcomes the problems associated with the manufacturing tolerances of the wiper and of the container relative to the height of the neck of the container.

The applicator member may be secured, via a connecting element, to a gripping member, said gripping member forming an element that is able to removably close said opening. Preferably, the gripping member forming a cap is screwed onto the neck of the container.

The applicator member may form an applicator for the eyelashes and/or eyebrows, in particular in the form of a brush with a twisted core gripping fibers or of a molded brush, an eyeliner applicator, a fine brush, a block of foam, a frit, a pen, or a felt tip.

The invention may be understood better from reading the following description accompanied by nonlimiting implementation examples thereof, with reference to the appended drawings, in which.

Figure 1:
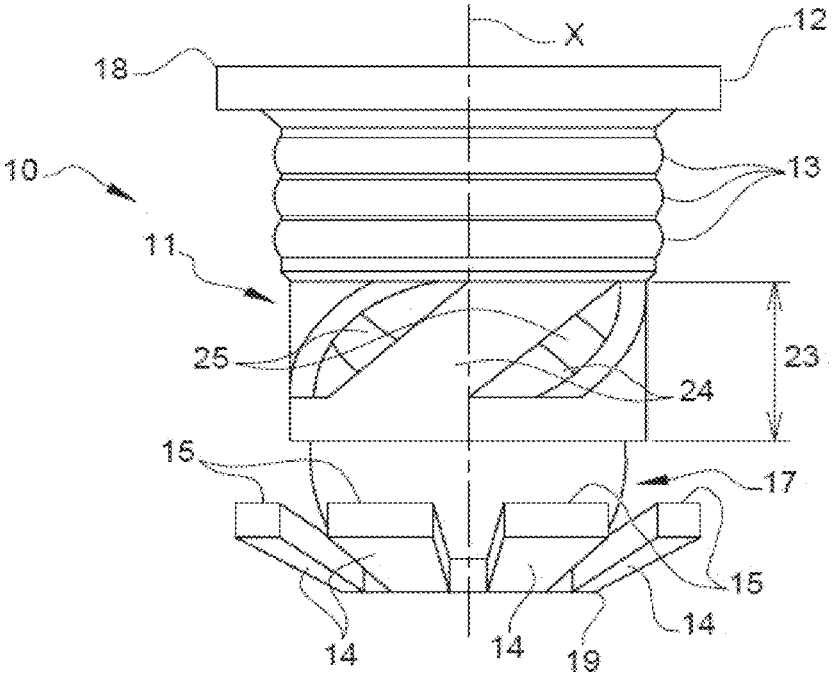
FIG. 1 is an overall front view of a wiper according to the invention.
Figure 2:
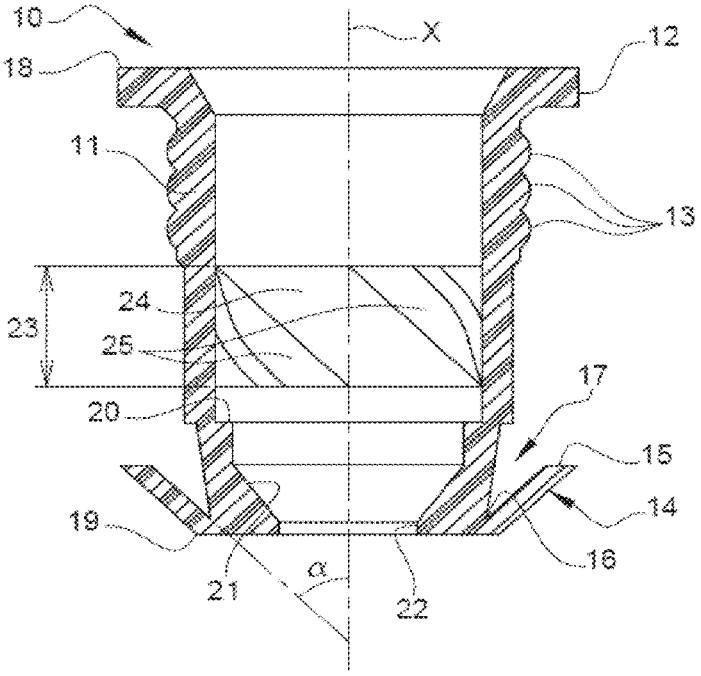
FIG. 2 is a view in longitudinal section of the wiper in FIG. 1.

The wiper 10 shown in FIGS. 1 and 2 comprises a generally tubular cylindrical body 11 extending along a longitudinal axis X.

The body 11 extends along the longitudinal axis X between a first end 19 intended, in the mounted position of the wiper in a container, to face a bottom of the container, and a second end 18 at the opposite end from the first end 19.

In the embodiment illustrated in the figures, the wiper is in one piece. The wiper may be made integrally of an elastically deformable material. In particular, the wiper may be made of elastomer, and for example of EPDM (ethylene-propylene-diene monomer). In a variant, the wiper may be made entirely or partly with an elastically deformable material chosen from thermoplastic or crosslinked elastomers, natural rubbers, nitrile, butyl or silicone elastomers. The wiper may also be made of a material that is more rigid than those mentioned above, for example a material having a Young's modulus greater than or equal to 200 MPa. In particular, the wiper may be made of a material chosen from polymers, for example polyolefins, such as polyethylene (PE), or thermoplastic polymers, such as polypropylene (PP), polybutylene terephthalate (PBT), or acrylonitrile butadiene styrene (ABS).

The second end 18 of the body 11 has a rim 12 formed of an annular flange that extends outward in the radial direction from the tubular part of the body 11 at the second end thereof 18 and is designed to come to bear against an edge of a container delimiting an opening in the latter, as will be described in more detail below.

Beneath the rim 12 along the longitudinal axis X and in the direction of the first end 19 of the body 11 of the wiper, the tubular part of the body 11 has, on its outer surface, in the radial direction, three consecutive annular bulges 13 along the longitudinal axis X. These annular bulges 13 are intended to come into contact, preferably with a fairly close fit, with the inner surface of the neck of a container when the wiper 10 is mounted thereon in order to ensure leaktightness between the wiper 10 and the neck of the container.

The body 11 of the wiper 10 has, in the vicinity of its first end 19, coupling means 14 that are intended to couple the wiper 10 to a container.

Thus, in the embodiment illustrated, the body 11 of the wiper 10 has, on its outer surface, in the vicinity of the first end 19, an annular, flexible lip that is discontinuous in the circumferential direction so as to form a plurality of flexible lips or coupling lugs 14, and in the present case six coupling lugs 14. In a variant, the annular lip may be continuous in the circumferential direction.

The coupling lugs 14 each have a first end attached to the body 11 in a joining zone 16 and a second, free end 15 oriented in the direction of the second end 18 of the body 11.

When no load is applied to them, the coupling lugs 14 form an acute angle $\alpha$ with the longitudinal axis X of the body 11. In the embodiment illustrated, the angle $\alpha$ is around 45°.

By virtue of these dispositions, the coupling lugs 14 are designed so as to offer resistance to the introduction of the wiper into a container that is substantially less than the resistance that they offer during the withdrawal of the wiper from the container.

Each coupling lug 14 is connected to the body 11 via a joining zone 16 that extends substantially in a plane perpendicular to the longitudinal axis X of the body 11.

Next to the coupling lugs 14, and over a height corresponding substantially to the height of the latter, the outer surface of the body 11 forms a recess 17, the depth of which decreases gradually from the joining zones 16 between the coupling lugs 14 and the body 11. In the embodiment illustrated, this recess 17 is in the form of a frustoconical outer-surface portion, the small base of which is situated in the vicinity of the first end 19 of the body 11, a radial step connecting the recess 17 to the outer surface of the body 11.

The body 11 also has, in the vicinity of its first end 19, a part 21, 22 that forms the actual wiping member.

The inner wall of the body 11 has, in the vicinity of this first end 19, a frustoconical inclined wall 21, the generatrix of which forms an angle of for example around 45° with the longitudinal axis X of the body, said wall 21 closing up towards the first end 19 of the body 11. This frustoconical wall 21 opens onto the outside of the wiper 10 at the first end 19 of the body 11 via an orifice 22 of reduced section. This orifice 22 determines the wiping diameter of the wiper 10. When there is no load, the orifice 22 has a diameter less than the maximum diameter of the applicator member for which the wiper is intended.

Furthermore, the body 11 of the wiper 10 according to the invention comprises a portion 23 that is elastically deformable along the longitudinal axis X and is provided axially between the supporting rim 12 and the coupling means 14, this elastically deformable portion being in the form of an openwork portion of the body 11.

As can be seen in particular in FIGS. 1 and 2, the openwork portion 23 of the body 11 comprises at least one, and in the present case four ribs 24 that are regularly distributed about the longitudinal axis X and each extend helically along the longitudinal axis X over an angular range of around 90°, the four ribs 24 being separated from one another in the circumferential direction by apertures 25 that likewise extend helically along the longitudinal axis X. The apertures 25 are through-apertures and are formed in the wall of the body 11, the ribs being constituted of the remaining part of the wall of the body 11.

The wiper according to the invention thus has an axially extensible internal portion that has a long path of axial extension, the helical ribs 24 allowing substantial elastic extension in the direction of the longitudinal axis X under the effect of a load exerted on one of the axial ends thereof, the other axial end being kept fixed.

As can be seen in particular in FIG. 2, the body 11, and more specifically the inner surface of the body 11, has a shoulder 20 that extends inwardly in the radial direction and is situated along the longitudinal axis X between the elastically deformable openwork portion 23 and the coupling lugs 14.

Thus, and as will be seen in more detail below, when the rim 12 of the wiper 10 is resting against the edge of the neck of a container, an axial force exerted on the shoulder 20 causes the elastically deformable openwork portion 23 to be axially stretched.

Figure 3:
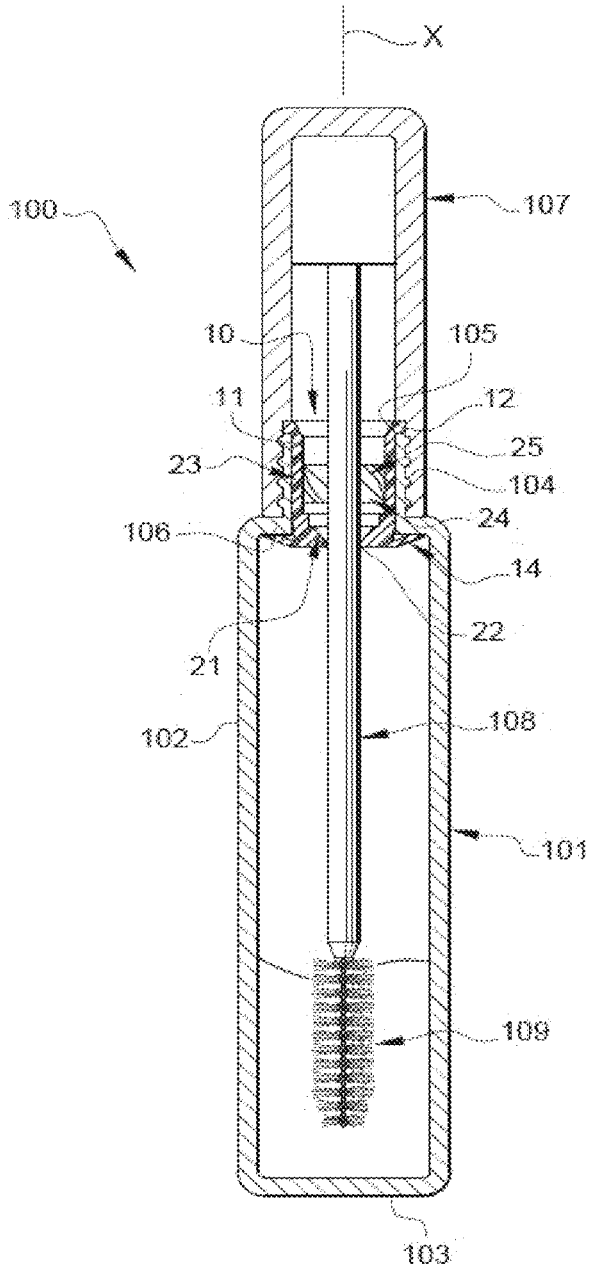
FIG. 3 is a view in longitudinal section of a packaging and application assembly equipped with a wiper according to the invention, the wiper being shown in an overall view.

FIG. 3 shows a view in longitudinal section of an assembly 100 for packaging and applying mascara that is equipped with a wiper 10 as described with reference to FIGS. 1 and 2, the wiper being shown in an overall view.

Such an assembly 100 comprises a container 101 comprising a cylindrical body 102, one end of which is closed by a bottom 103. At the opposite end from the bottom 103, the body 102 is surmounted by a threaded neck 104, a free edge of which delimits an opening 105. The neck 104 is connected to the cylindrical body 102 by a shoulder 106.

Mounted in the neck 104 is a wiper 10 as discussed with reference to FIGS. 1 and 2. As is clearly apparent from FIG. 3, in this mounted position, the coupling lugs 14 are disposed under the shoulder 106, being elastically loaded slightly against the shoulder 106. In this position, the radial width of the coupling lugs 14 is at a maximum. In this mounted position, the rim 12 of the wiper rests against the edge of the container delimiting the opening 105. The annular bulges 13 ensure effective leaktightness between the wiper 10 and the internal surface of the neck 104.

Screwed onto the threaded neck 104 is a lid 107. The lid 107 is secured to a stem 108, one end of which, at the opposite end from the lid 107, is secured to a mascara brush 109 that is molded or formed from a twisted iron wire trapping a helical arrangement of fibers.

In this screwed-on position of the lid 107 on the neck 104, the applicator 109 is substantially at the bottom of the container 101 and is in contact with the product contained therein. The stem 108 passes through the wiper and has a portion engaged with the edge of the wiping orifice 22.

Upon each use, the user unscrews the lid 107 and, using a substantially axial movement in a direction away from the bottom 103, withdraws the mascara brush 109 from the container 101.

During this withdrawing movement, the stem 108 is wiped by the edge of the wiping orifice 22 of the lip 21. Any excess product present on the brush 109 is removed when the latter passes through said wiping orifice 22.

Following application, she closes the assembly again using the opposite actions to those described for withdrawing the applicator 109.

FIGS. 4 to 8, to which reference will now be made, illustrate the steps of mounting a wiper as described in FIGS. 1 and 2 on a packaging and application assembly as shown in FIG. 3.

Figures 4, 5, 6, 7, 8:
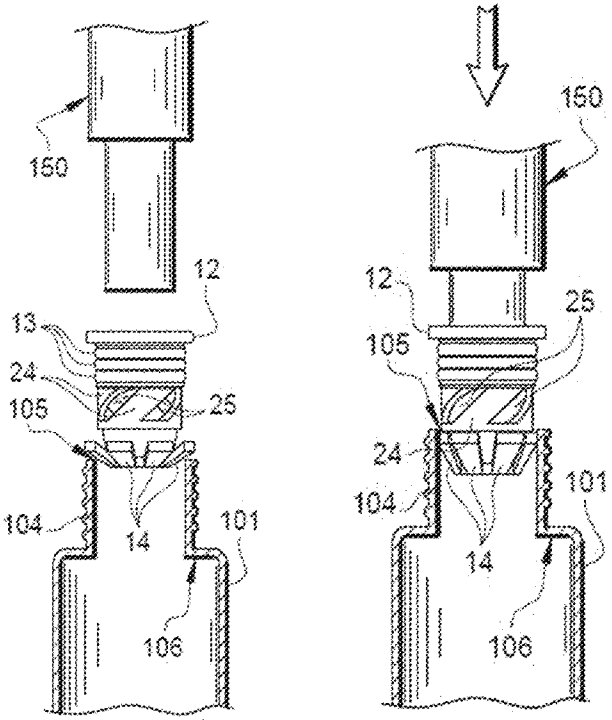
FIG. 4 illustrates a first step in the mounting of a wiper according to the invention on a container of a packaging and application assembly, the container being illustrated in longitudinal section and the wiper being shown in an overall front view.
FIG. 5 illustrates a second step in the mounting of a wiper according to the invention on a container of a packaging and application assembly, the container being illustrated in longitudinal section and the wiper being shown in an overall front view.
FIG. 6 illustrates a third step in the mounting of a wiper according to the invention on a container of a packaging and application assembly, the container being illustrated in longitudinal section and the wiper being shown in an overall front view.
FIG. 7 illustrates a fourth step in the mounting of a wiper according to the invention on a container of a packaging and application assembly, the container being illustrated in longitudinal section and the wiper being shown in an overall front view.
FIG. 8 illustrates a fifth step in the mounting of a wiper according to the invention on a container of a packaging and application assembly, the container being illustrated in longitudinal section and the wiper being shown in an overall front view.

In FIG. 4, the first end 19 of the body 11 of the wiper is placed in contact with the upper edge of the neck 104 of the container 101, with the coupling lugs 14 resting on this upper edge. The coupling lugs 14 form a stop for retaining the wiper in this position.

In FIG. 5, a tool of elongate shape 150 is introduced into the wiper until it comes into abutment against the shoulder 20 of the latter.

At this time, by continuing the axial movement of the tool 150 in the direction of the bottom of the container, as illustrated by the arrows in FIGS. 5 and 6, the wiper 10 is engaged further inside the neck 104 of the wiper. In doing so, the coupling lugs 14 of the wiper 10 fold up in the direction of the body 11. On account of the presence of the recess 17, inside which the coupling lugs 14 fit, the latter do not substantially form an overthickness in the radial direction with respect to the external surface of the tubular body 11. Fitted in the recess 17 in this way, the coupling lugs 14 do not have any substantial impact on the downward movement of the wiper in the neck 104 of the container. In the position illustrated in FIG. 6, the rim 12 of the wiper rests on the upper edge of the neck 104 of the container 101.

The downward movement of the tool 150 and consequently of the wiper 10 in the neck 104 then continues until the free ends 15 of the coupling lugs 14 are no longer next to the neck 104, as illustrated in FIG. 7. In this position, the elastically deformable openwork portion 23 of the wiper 10 is loaded in elongation, stretched along the longitudinal axis, by a sufficient axial length for the coupling lugs 14 to be able to open out freely in the radial direction by elastic return behind the shoulder 106 of the container 101. The coupling lugs 14 open out radially in order to return to their initial shape at 45° with respect to the longitudinal axis X.

During this axial stretching of the openwork portion 23, the helical ribs 24 deform and are made to straighten with respect to the longitudinal axis X, that is to say are made to deform so as to extend more in the direction of the longitudinal axis X than in the circumferential direction, like the behavior of the turns of a helical spring subjected to a tensile force.

In FIG. 8, the tool 150 starts to move out in the opposite direction to the bottom 103 of the container 101, as illustrated by the arrow indicated in FIG. 8. By elastic return of the openwork portion 23, the coupling lugs 14 are forced into engagement against the shoulder 106, and thus strongly oppose any movement that tends to cause the wiper 10 to come out of the container 101. Thus, the wiper 10 is now coupled solidly in the neck 104 of the container 101.

Preferably, in this position illustrated in FIG. 8, the openwork portion 23 is still slightly loaded in the elongation along the longitudinal axis X. This ensures that the coupling lugs 14 bear, optionally with a slight bend, behind the shoulder 106 of the container 101. The reliability of the fixing of the wiper 10 in the neck 104 of the container 101 is thus further improved.

Figure 9:
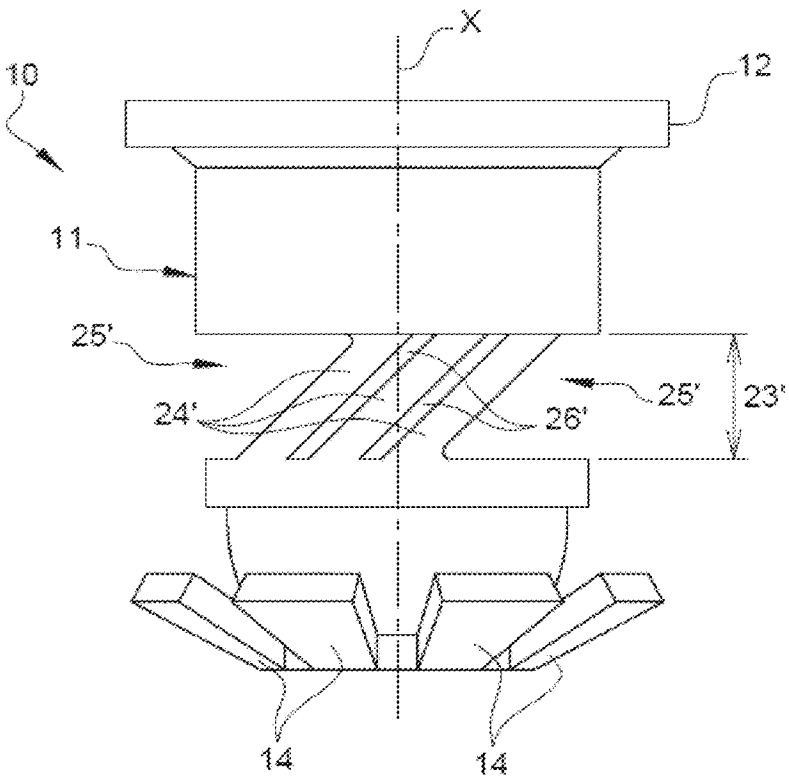
FIG. 9 is an overall front view of a wiper according to a first embodiment variant of the invention.

FIG. 9 illustrates a wiper according to a first embodiment variant of the invention.

In this first embodiment variant, only the openwork portion 23' is modified compared with the wiper illustrated in FIGS. 1 to 8.

As can be seen in this FIG. 9, in this first embodiment variant, the openwork portion 23' comprises two groups of at least two and in particular three ribs 24', each of the ribs 24' of each group extending helically along the longitudinal axis X. The two groups of ribs 24' are diametrically opposite one another about the longitudinal axis X. Each of the ribs extends through an angular range of less than 90°, in particular around 45°, about the longitudinal axis X. The ribs 24' of each group are separated from one another in the circumferential direction by slots 26'. The groups of ribs 24' are separated from one another in the circumferential direction by apertures 25'.

Figure 10:
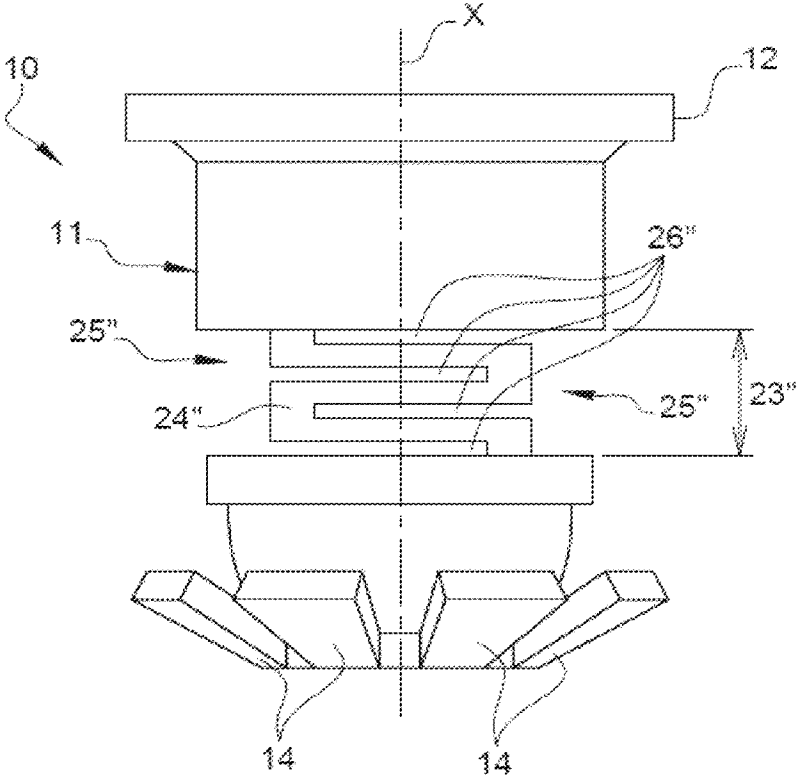
FIG. 10 is an overall front view of a wiper according to a second embodiment variant of the invention.

FIG. 10 illustrates a wiper according to a second embodiment variant of the invention.

In this second embodiment variant, only the openwork portion 23" is modified compared with the wiper illustrated in FIGS. 1 to 8.

As can be seen in this FIG. 10, in this second embodiment variant, the openwork portion 23" comprises at least one rib 24", and in the present case two diametrically opposite ribs 24", extending in a zigzag along the longitudinal axis X. The ribs 24" comprise portions extending in the circumferential direction that are separated from one another along the longitudinal axis X by slots 26" and are connected together and to the body 11 of the wiper by portions extending parallel to the longitudinal axis X. The ribs 24" are separated from one another in the circumferential direction by apertures 25". In this embodiment variant, each rib 24" extends about the longitudinal axis X through an angular range of around 90°.

In all of the embodiment variants of the wiper that have been described and illustrated, the openwork portion 23, 23', 23" makes it possible to have, within the wiper, a portion with an increased deformation capability, and in particular an increased axial extension capability. Other embodiments of the openwork portion of the wiper may be envisioned without departing from the scope of the present invention.

The invention claimed is:

1. A wiper intended to be fitted on a container containing a product, in particular a cosmetic product, to be applied by means of an applicator, said wiper comprising:

a cylindrical body extending along a longitudinal axis, a part of which forms the actual wiping member, said body having, along the longitudinal axis;

a rim that is able to rest on an edge of the container delimiting an opening therein;

coupling means intended to couple the wiper to the container; and a portion that is elastically deformable along the longitudinal axis and is provided between said rim and said coupling means, wherein the elastically deformable portion is in the form of an openwork portion of the body, and wherein the inner surface of the body has a shoulder extending radially inwardly and situated along the longitudinal axis between the elastically deformable portion and the coupling means.

2. The wiper as claimed in claim 1, wherein the openwork portion of the body comprises at least one rib that extends helically along the longitudinal axis and is bordered by two apertures in the circumferential direction, said apertures extending preferably helically along the longitudinal axis.

3. The wiper as claimed in claim 1, wherein the openwork portion comprises four ribs that extend preferably helically along the longitudinal axis, said ribs being distributed preferably regularly about the longitudinal axis, each of the ribs extending in particular through an angular range of around 90°, said ribs being separated from one another in the circumferential direction by apertures.

4. The wiper as claimed in claim 1, wherein the body has, along the longitudinal axis, a first end that is intended, in the mounted position of the wiper on the container, to face a bottom of the container, and a second end at the opposite end from the first, and wherein the coupling means comprise at least one flexible lip extending over the outer surface of the body, a first end of which is attached to the body in a joining zone, a second end of the lip being free, and wherein said lip, when not under load, forms an acute angle with the longitudinal axis of the body so as to offer resistance to the introduction of the wiper into the container that is substantially less than the resistance that said lip offers when the wiper is withdrawn from the container.

5. The wiper as claimed in claim 4, wherein the angle is preferably between 30° and 60°, preferably between 35° and 55°, and in particular around 45°.

6. The wiper as claimed in claim 4, wherein the outer surface of the body has, next to the coupling means, a recess, so as to further reduce the resistance offered to the introduction of the wiper into the container by said coupling means.

7. The wiper as claimed in claim 1, wherein at least the wiping member, the coupling means, and the elastically deformable portion are made of an elastically deformable material.

8. The wiper as claimed in claim 7, wherein the elastically deformable material is chosen from thermoplastic or cross-linked elastomers, in particular EPDMs, natural rubbers, nitrile, butyl or silicone elastomers, polymers, for example polyolefins, such as polyethylene, or thermoplastic polymers, such as polypropylene, polybutylene terephthalate, or acrylonitrile butadiene styrene.

9. An assembly for packaging and applying a product, in particular a cosmetic product, said assembly comprising a container designed to contain the product, and an applicator member for applying said product, wherein said assembly also comprises a wiper as claimed in claim 1, said wiper being able to be passed through by said applicator member when the latter is withdrawn from the container, so as to allow the quantity of product remaining on the applicator member to be metered.

10. The packaging and application assembly as claimed in claim 9, wherein the container comprises a body that is separated from a neck by a shoulder, a free edge of said neck delimiting an opening in the vicinity of which the wiper is mounted.

11. The packaging and application assembly as claimed in claim 10, wherein, in the mounted position of the wiper on the container, the coupling means are substantially in abutment against the shoulder.

12. The packaging and application assembly as claimed in claim 9, wherein, in the mounted position of the wiper on the container, the coupling means and/or the elastically deformable portion are elastically loaded along the longitudinal axis.

13. The packaging and application assembly as claimed in claim 9, wherein the applicator member is secured, via a connecting element, to a gripping member, said gripping member forming an element that is able to removably close the opening in the container.

14. The packaging and application assembly as claimed in claim 9, wherein the applicator member forms an applicator for the eyelashes and/or eyebrows, in particular in the form of a brush with a twisted core gripping fibers or of a molded brush, an eyeliner applicator, a fine brush, a block of foam, a frit, a pen, or a felt tip.

* * * * *